United States Patent [19]

Howell

[11] 3,999,828

[45] Dec. 28, 1976

[54] CORD CONNECTOR AND STRAIN RELIEVER

[75] Inventor: Roy D. Howell, Jackson, Tenn.

[73] Assignee: Rockwell International Corporation, Pittsburgh, Pa.

[22] Filed: May 13, 1975

[21] Appl. No.: 577,234

[52] U.S. Cl. ..... 339/75 P
[51] Int. Cl.[2] ..... H01R 13/54
[58] Field of Search ..... 339/75 P, 91 R

[56] References Cited

UNITED STATES PATENTS

| | | | |
|---|---|---|---|
| 3,005,176 | 10/1961 | Berg | 339/75 P |
| 3,014,194 | 12/1961 | Berglund | 339/75 P |

*Primary Examiner*—Roy Lake
*Assistant Examiner*—Mark S. Bicks

[57] ABSTRACT

An accessory for bridging the connection between two electrical conductor cords, which acts as a strain reliever and serves to keep the connection engaged.

7 Claims, 5 Drawing Figures

FIG. 1.
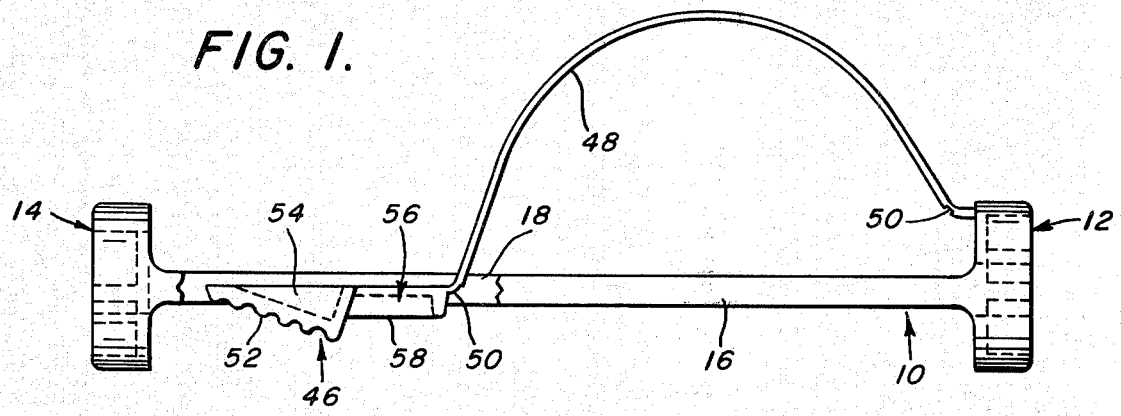
FIG. 2.
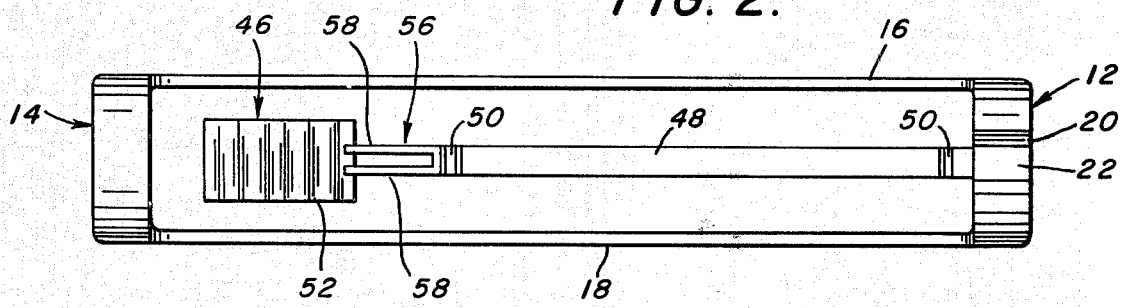
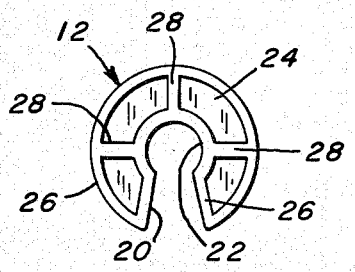
FIG. 3.
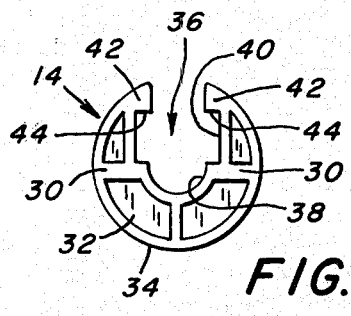
FIG. 4.
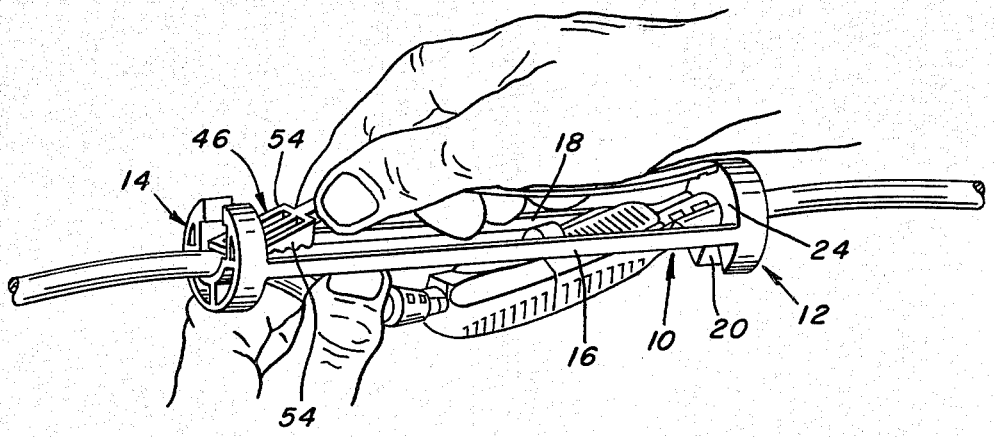
FIG. 5.

CORD CONNECTOR AND STRAIN RELIEVER

BACKGROUND OF THE INVENTION

This invention is a novel device for relieving the strain on a connection between electrical conductor cords and for maintaining the connection. Many of todays power tools, especially garden tools, require an extension cord to supply the power to the point of use of the tool. An irritating and time-consuming annoyance usually occurs when the connection becomes dis-engaged. This can happen from any number of causes, for instance when the extension becomes entangled with shrubbery, or furniture inside the house, or from other causes. When the tool operator pulls on the tool, separation occurs. Other ways of disengaging the connection are easily envisioned.

Heretofore known devices intended to hold the connection together have been unsatisfactory in that they cannot be found when needed, or tend to obscure or hide the connection, or fail to provide the strain relief so desirable to avoid damage to the plugs or conductors. For example, U.S. Pat. No. 3,475,716 shows a strap of flexible, stretchable material which is permanently connected to one conductor, which provides no strain relief, but is developed to prevent accidental separation of the plug and socket connection. Another example of prior art is U.S. Pat. No. 2,461,427, which purports to be a tension absorber, but in reality would put a sideways strain on the juncture of the conductor wires with socket 10 and plug 11. Also, U.S. Pat. No. 3,223,958 illustrates another attempt to solve the disconnection problem. In this embodiment, however, the clamp must be disconnected from both wires, and thus is in danger of being mislaid, and not available when needed.

Accordingly, it is a principal object of this invention to provide a multi-purpose accessory that will retain electrical conductors in the connected condition, and also provide strain relief for longer cord life and greater safety.

It is a further object of the invention to disclose a multi-purpose accessory that can be retained on a conductor, but selectively removed as desired.

It is a further object of this invention to provide a device that will easily and efficiently connect across a connection between two conductor wires and transfer any longitudinal pulling force across the connection without application of this force to the plug or socket of the connection.

It is also a primary object of this invention to provide a simple, durable, economical, dependable attachment for retaining electrical cords in assembled condition.

SUMMARY OF THE INVENTION

This attachment is preferably made of a flexible, non-stretch material and has the ends sized to receive the insulated conductor cords used with power tools and extensions commonly used therewith. One end receives one wire in a V-shaped recess, while the other end has a semi-circular recess in the center for partially receiving the other conductor wire. This semi-circular recess connects with a slot designed to receive a wedge for bearing on the conductor. The two ends are connected by straps that transmit any pulling action across the electrical connection without placing strain on the conductors. The wedge is attached to the attachment by a flexible strap having finger grips for inserting and removing the wedge.

BRIEF DESCRIPTION OF THE DRAWINGS

FIG. 1 is a side view with a portion of the side strap broken away to show the wedge and finger grip in greater detail;

FIG. 2 is a bottom view of the cord connector;

FIG. 3 is a view of one end, showing the notch for the wire;

FIG. 4 is a view of the other end, adapted to receive the wire and the wedge; and FIG. 5 is a perspective view showing the method of attaching the connector to electric conductor wires.

DESCRIPTION OF THE INVENTION

The strain-relief connector of this invention is a straight-line semi-flexible member that is designed to be attached to an electric cord, such as an extension cord, and a conductor wire of a power tool. One end is designed to snap onto a cord, and to frictionally grip the cord. The other end is constructed to engage the other cord on the side of the connected plugs remote from the first-mentioned cord, and to wedge this second cord in between the wedging member and the second end member. This connector member is designed to be molded from semi-rigid plastic as a unitary member, and has suitably designed reinforcing ribs incorporated into the end members to provide the necessary structured rigidity. The wedge is attached to the strain relief member proper by a strap, to keep from losing it.

In the drawings, 10 denotes the strain-relief cord connector having ends 12 and 14 connected by straps 16 and 18. End 12 has a tapered slot 20 for reception of an insulated electrical conductor wire and a recess 22 at the bottom of slot 20 for retention of the wire. The end 12 can be of any desired configuration, but in this embodiment it has a circular cross-section when viewed from the end, as in FIG. 3. A stiffening rim 26 is provided around the periphery and around openings 20 and 22 while ribs 28 also contribute to the structural integrity. All of these are mounted on a plate-like member 24. It should be understood that this member could be another external configuration, so long as the tapered slot 20 and recess 22 are provided therein. However, for light weight combined with relatively rigid construction, this has been found to be the optimum design.

The other end 14 has a similar configuration, however, the slot is slightly different in shape, and the reinforcing ribs 30 are placed to accommodate the wedge (which will be described later) as well as the conductor cord. End 14 has a plate-like member 32 and a stiffening rim 34 similar to end 12. The opening 36 for reception of the conductor cord has a recess 38 in the bottom molded to receive the usual size of cord used with portable hand-held tools. Immediately radially outwardly of recess 38, however, the opening 36 enlarges to a size 40 to accommodate a wedge 46. Wedge 46 is designed to be closely, but freely, received in the enlarged portion 40 of opening 36 for the initial insertion, but the height of enlarged portion 40 is determined by shoulders 42 and is designed to be less than the maximum height of wedge 46. Shoulders 42 are spaced apart to provide an opening for free passage of the conductor cord, but inner faces 44, of shoulders 42 are designed to bear on the longitudinal reinforcing ribs of wedge 46. Also, the recess 38 in the bottom of opening 36 is shaped to accommodate a conductor cord, with a portion of the cord protruding above horizontal ribs 30 (as seen in FIG. 4), so that the wedge 46 may contact the conductor cord.

Wedge 46 is integrally molded with the body of the invention and preferably has a strap 48 connecting it to end 12. It is understood that wedge 46 need not be connected, or not necessarily connected in this particular manner, but to avoid losing the wedge, it is preferably molded in this fashion. Strap 48 has notches 50 provided for ease of bending the material in inserting and removing the wedge 46, as shown in FIG. 5. Wedge 46 is provided with a corrugated face 52 for contacting and gripping conductor wires, on the inner surface, and reinforcing ribs 54 forming the remainder of the wedge shape. Abutting the large end of the wedge 46 is a finger grip 56 connecting wedge 46 to strap 48, for convenience in manipulating wedge 46. This finger grip 56 can be of any convenient shape, but preferably with flat parallel sides 58, which are parallel to the parallel sides of wedge 46.

The operation of the strain-relief cord connector is best shown in FIG. 5. After snapping one conductor into recess 22 of end 12 adjacent the connector for that conductor wire, the conductor to which it is desired to make connection is pulled through opening 36 of end 14, and the connection between conductors is effected. Then, making certain that some slack exists in the conductors between ends 12 and 14, the wedge 46 is inserted into enlarged portion 40 of end 14, and pushed into engagement with the conductor on corrugated face 52 and with faces 44 of shoulders 42 on ribs 54 of wedge 46. Then any pull on the conductor of end 14 tends to tighten the grip of wedge 46 and end 14 on the conductor, which force is transmitted through straps 16 and 18 to end 12, relieving any strain on the connection of the conductors.

While a particular embodiment of the invention has been described and illustrated in detail, this has been done for the purpose of disclosure of the invention and without any intention to limit the invention thereto.

I claim:

1. A strain relief attachment for electrical wires comprising coextensive straps connected at respective ends by first and second end members adapted to receive insulated electrical conductor wire therethrough, the first of said end members also being formed to receive a wedge, a wedge connected to said relief attachment by a flexible retainer means, said wedge cooperating with said first end member to grip said conductor wire, and the second of said end members being formed to bear against a proturberance on said conductor wire.

2. The attachment of claim 1 wherein said flexible retainer means has finger gripping surfaces formed thereon adjacent said wedge.

3. The attachment of claim 1 wherein said end members are of circular cross-section, with a radial slot in each for reception of said conductor wire.

4. The attachment of claim 3 wherein said second member slot is substantially pie-shaped, and has a point portion rounded to receive said conductor wire.

5. The attachment of claim 4 wherein said first end member slot is rounded in the bottom to partially receive said conductor wire, the slot therein has sides which are generally parallel and dimensioned to snugly receive said wedge.

6. The attachment of claim 5, in which said slot sides are provided with shoulders at the radially outwardly ends of said slot, and said shoulders have facing surfaces spaced apart for reception of said conductor wire.

7. The attachment of claim 1, in which said wedge has a surface for engaging said conductor wire which is provided with transverse serrations.

* * * * *